US006454359B1

(12) United States Patent
Kang

(10) Patent No.: US 6,454,359 B1
(45) Date of Patent: Sep. 24, 2002

(54) METHOD FOR BLASTING TUNNELS USING AN AIR BLADDER

(76) Inventor: Dae Woo Kang, Shinagegum 455 Gaegum LG Apt. 216-1702, 455 Gaegum-dong, Busanjin-gu, Busan 614-751 (KR)

( * ) Notice: Subject to any disclaimer, the term of this patent is extended or adjusted under 35 U.S.C. 154(b) by 0 days.

(21) Appl. No.: 09/697,654

(22) Filed: Oct. 26, 2000

(30) Foreign Application Priority Data

Oct. 30, 1999 (KR) ..... 99-47841

(51) Int. Cl.[7] ..... E21C 47/00; F42B 3/00

(52) U.S. Cl. ..... 299/13; 102/312; 102/313; 102/333; 175/2; 166/187; 166/285

(58) Field of Search ..... 299/13; 102/304, 102/311, 312, 313, 333; 175/2; 166/187, 192, 285, 292

(56) References Cited

U.S. PATENT DOCUMENTS

| | | | | | |
|---|---|---|---|---|---|
| 4,736,796 | A | * | 4/1988 | Arnall et al. | 102/333 X |
| 4,813,358 | A | * | 3/1989 | Roberts | 102/313 |
| 4,913,233 | A | * | 4/1990 | Fitzgibbon, Jr. | 166/285 |
| 4,919,203 | A | * | 4/1990 | Fitzgibbon, Jr. | 166/187 |
| 5,000,261 | A | * | 3/1991 | Fitzgibbon, Jr. | 166/187 |
| 5,035,286 | A | * | 7/1991 | Fitzgibbon, Jr. | 166/187 |
| 5,634,691 | A | * | 6/1997 | Kim et al. | 299/13 |
| 5,803,172 | A | * | 9/1998 | Rajkovich | 166/187 X |
| 5,841,060 | A | * | 11/1998 | Skaggs | 102/333 |
| 6,209,458 | B1 | * | 4/2001 | Thomson et al. | 102/333 |
| 6,213,212 | B1 | * | 4/2001 | Jenkins, Jr. et al. | 299/13 X |

FOREIGN PATENT DOCUMENTS

| | | | | |
|---|---|---|---|---|
| GB | 2080856 | * | 2/1982 | 102/312 |
| JP | 06129800 | * | 5/1994 | 102/301 |
| JP | 06323797 | * | 11/1994 | |

OTHER PUBLICATIONS

Advertisement for Vari–Stem "Greater Rock Fragmentation, Less Cost" The Journal of Explosives Engineering, ISEE Drilling Section, p. 22, Jul./Aug. 1999.

"Numerical Modelling of the Effects of Air Decking/Decoupling in Production and Controlled Blasting" by Liu et al., Rock Fragmentation by Blasting, Mohanty (ED), 1996 Balkema, Rotterdam, ISBN 90 5410 824 X, pp. 319–330.

"Ground Vibration From Single–Hole Cast Blasts" by Yang et al., The Journal of Explosive Engineering, pp. 37–41, Mar./Apr. 1999.

* cited by examiner

*Primary Examiner*—Heather Shackelford
*Assistant Examiner*—Jong-Suk Lee
(74) *Attorney, Agent, or Firm*—Sheridan Ross PC

(57) ABSTRACT

A tunnel blasting method is disclosed. The method including the step of drilling blast holes such as cut holes, cut spreader holes, floor holes and roof holes to predetermined depths and in a predetermined hole arrangement. The blast holes are loaded with one or more detonators and explosives, stemming the blast holes with stemming materials. The detonators are detonated using a triggering device. In the hole loading step, one or more air bladders are situated in each of the blast holes so that a front free surface or one or more small free surfaces are formed. As a result, a projective area toward a free surface is enlarged and a total blast pressure is increased to increase the fragmentation rate of a rock and reduce blast vibration.

6 Claims, 9 Drawing Sheets

FIG. 1
PRIOR ART
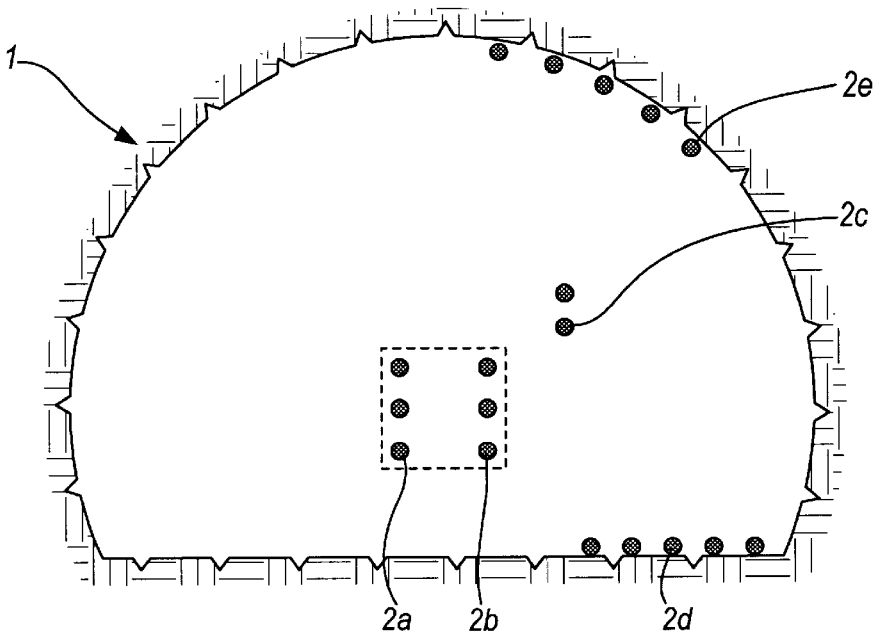
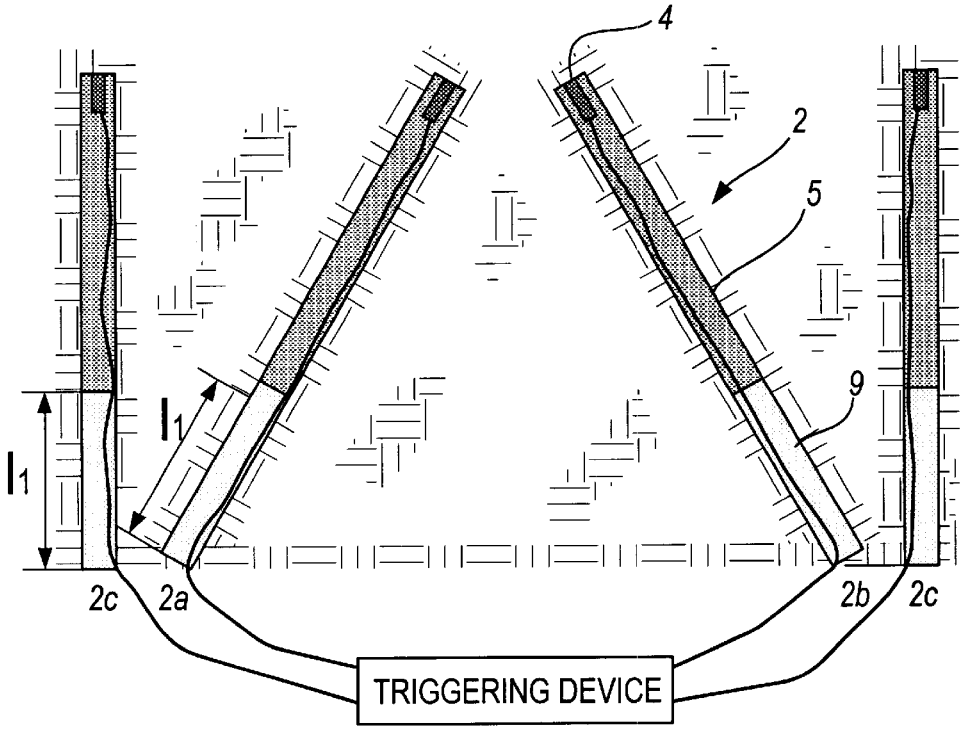
PRIOR ART
FIG. 2a

METHOD FOR BLASTING TUNNELS USING AN AIR BLADDER

BACKGROUND OF THE INVENTION

1. Field of the Invention

The present invention relates generally to tunnel excavating methods, and more particularly to a tunnel blasting method using an air bladder, in which one or more air bladders are situated in each blast hole to form a front free surface in each cut hole or one or more small free surfaces in the other blast holes, thereby decreasing blast vibration and blast noise, reducing the amount of explosive considerably, preventing the production of boulders and suppressing initial vibration.

2. Description of the Prior Art

As well known to those skilled in the art, tunnel excavating methods using blasting techniques may be classified into a full-scale blasting method, a divisional blasting method and a multistage blasting method. The tunnel excavating methods using blasting techniques are performed with the following three stages in common.

A first stage is the stage of drilling cut holes, cut spreader holes, floor holes and roof holes to predetermined depths, a second stage is the stage of loading the drilled holes with detonators and explosives, and a third stage is the stage of detonating the detonators using a triggering device.

As shown in FIGS. 1 to 2*d,* in the conventional blasting methods, positions where cut holes 2*a* and 2*b,* cut spreader holes 2*c,* floor holes 2*d* and roof holes 2*e* are to be drilled are marked on a working face, the blast holes are drilled to appropriate depths on the working face at the marked positions using a drilling machine such as a rock drill or jumbo drill, and the blast holes are respectively loaded with delay detonators and explosives.

With regard to the above-described tunnel blasting stages, a detailed description of the drilling and detonating stage are not necessary because these stages are well known, but the hole loading stage should be described in detail because this stage is complicated.

FIGS. 2*a* to 2*d* are views, which are concerned with prior art and show states in which the blast holes are respectively loaded with delay detonator and explosive combinations and are respectively stemmed with stemming material 9. In the drawings, FIGS. 2*a* and 2*b* are views respectively showing states in which the cut holes 2*a* and 2*b* are loaded with the delay detonators and the explosives and stemmed with stemming material 9. FIG. 2*c* is a view showing a state in which the cut holes 2*a* and 2*b* are loaded with the delay detonators and the explosives and stemmed with stemming material 9.

In most blast hole loading stages of the conventional tunnel blasting methods, explosives are detonated in a state in which the lower portions of blast holes are loaded with delay detonators 4 and explosives 5 and the upper portions of the blast holes are loaded with stemming materials 9.

In such cases, the blast holes are loaded with the delay detonators 4 and the explosives 5 at their lower portions. The explosives 5 employed in these cases may be classified into general explosives and precision explosives. The cut holes 2*a* and 2*b,* the cut spreader holes 2*c* and the floor holes 2*d* are loaded with the general explosives 5, while the roof holes 2*e* and other outer side holes are loaded with the general explosives and the precision explosives so as to reduce the damage to the parent rock. In some cases, the roof holes are alternatively loaded with the explosives 5 so as to form non-loaded blast holes 3.

The cut holes 2*a* and 2*b* are loaded with delay detonators in a way of symmetrically situating the detonators in the cut holes 2*a* and 2*b* in the upward order. The cut spreader holes 2*c,* the floor holes 2*d* and the roof holes 2*e* are loaded with delay detonators in a way of situating the detonators in the holes 2*c,* 2*d* and 2*e* in the order of progressing from the center to the outside. In such a state, the tunnel is blasted by detonating the detonators using a triggering device. The detonations of the detonators are sequentially performed in the order of the cut holes 2*a* and 2*b,* the cut spreader holes 2*c,* the floor holes 2*d* and the roof holes 2*e*.

Referring to FIGS. 3*a* and 3*c,* in the conventional tunnel blasting method, since the explosion length of the explosive 5 is confined to the length of the explosive 5 and the length $l_1$ of the stemming material 9 is relatively large in comparison with the depth of the blast hole 2, the projective area of the explosives 5 can be enlarged when the explosives 5 are detonated in the blast holes 2. Therefore, in the case of the conventional tunnel blasting method, since the explosion power of the explosives 5 is not fully utilized to fragment a rock, it is not an effective tunnel blasting method.

The detonators 4 and the explosives 5 are situated in the center and inner portions of the blast holes 2, so that the vibration of the ground is great. Additionally, upon detonation of the explosives, the stone formation portion A of a rock inside a fracture boundary line L is fragmented into a large number of stones, while the boulder formation portions B of the rock outside the fracture boundary line L are fractured into a small number of boulders. The explosion power of the explosives cannot reach the boulder formation portions B around the stemming materials 9 due to the presence of the stemming materials 9, so that the boulder formation portions B are not fragmented into the stones.

Meanwhile, although the roof holes 2*e* are loaded with the precision explosives 6 so as to smooth the blasted surfaces of a roof and sidewalls, there occur problems in which the precision explosives are expensive, the usage of the precision explosives is difficult and the safety of work is deteriorated due to blast failure.

The conventional tunnel blasting method utilizes a single free surface. Consequently, unacceptable blast vibration and blast noise are generated because the explosive charges are concentrated in the inner portions of the blast holes, and an additional post-process such as a shotcreting process is required because the wall surface of the blasted tunnel is uneven.

In addition, since the tunnel blasting is performed using a single free surface, the travel distance of the fly rocks is increased, thereby requiring a long safety distance.

In particular, in the tunnel blasting methods, the vibrations of the ground generated upon blasting displease persons and damage neighboring structures, so that complaints against the operations may be made to hinder the operations. Accordingly, the development of a technique for reducing blast vibrations in the cut holes that greatly influences the vibration of the ground is urgently required.

SUMMARY OF THE INVENTION

Accordingly, the present invention has been made keeping in mind the above problems occurring in the prior art, and an object of the present invention is to provide a tunnel blasting method, in which cut holes are drilled deeper than the other blast holes and air bladders are situated in the extended portions of the cut holes to form front free surfaces, thereby suppressing initial blast vibration and blast noise generated in the cut holes and increasing the advances of the cut holes.

Another object of the present invention is to provide a tunnel blasting method, which increases a specific surface area on which explosion power is exerted, provides an additional free surface and allows explosives to be situated near a working face, thereby reducing the total amount of explosives used.

A further object of the present invention is to provide a tunnel blasting method, in which explosives are detonated at predetermined time intervals using the action of sympathetic blasting so as to reduce blast vibration and rubber plugs are inserted into the outer portions of blast holes to reduce blast vibration and blast noise.

Yet another object of the present invention is to provide a tunnel blasting method using an air bladder, which allows blast holes to be loaded with cartridge explosives and causes the explosive energy of explosives to be uniformly exerted on the surfaces of the blast holes, thereby blasting a tunnel at a low cost and obtaining a smooth blasted surface.

In order to accomplish the above object, the present invention provides a tunnel blasting method, comprising the steps of drilling blast holes such as cut holes, cut spreader holes, floor holes and roof holes to predetermined depths and in a predetermined hole arrangement, loading the blast holes with one or more detonators and explosives, stemming the blast holes with stemming materials and detonating the detonators using a triggering device, wherein one or more air bladders are situated in each of the blast holes so that a front free surface or one or more small free surfaces are formed, thereby enlarging a projective area toward a free surface and increasing a total blast pressure so as to increase the fragmentation rate of a rock and reduce blast vibration.

In accordance with a feature of the present invention, the cut holes are drilled deeper than an advance line and air bladders are inserted into the deeper portions of the cut holes, so that front free surfaces are respectively formed in the cut holes and explosives are situated near a free surface, thereby distributing blast vibration toward the front free surfaces and the free surface.

In accordance with a feature of the present invention, each of the blast holes is alternately loaded with the explosives and the air bladders.

In accordance with a feature of the present invention, a single detonator is situated in each blast hole so that the explosives are detonated by the action of sympathetic detonation.

In accordance with a feature of the present invention, each of the blast holes is sealed at its outer portion with a rubber plug so as to reduce blast noise.

In accordance with a feature of the present invention, the diameter of each of the air bladders is equal to or less than the diameter of each of the blast holes.

In accordance with a feature of the present invention, the air bladders are made of synthetic resin, such as polyethylene, polypropylene, polyester or polyamide.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a front view showing a conventional blast hole arrangement;

FIG. 2*a* is a cross section showing conventionally loaded cut holes;

DESCRIPTION OF THE PREFERRED EMBODIMENTS

Figure 2B:
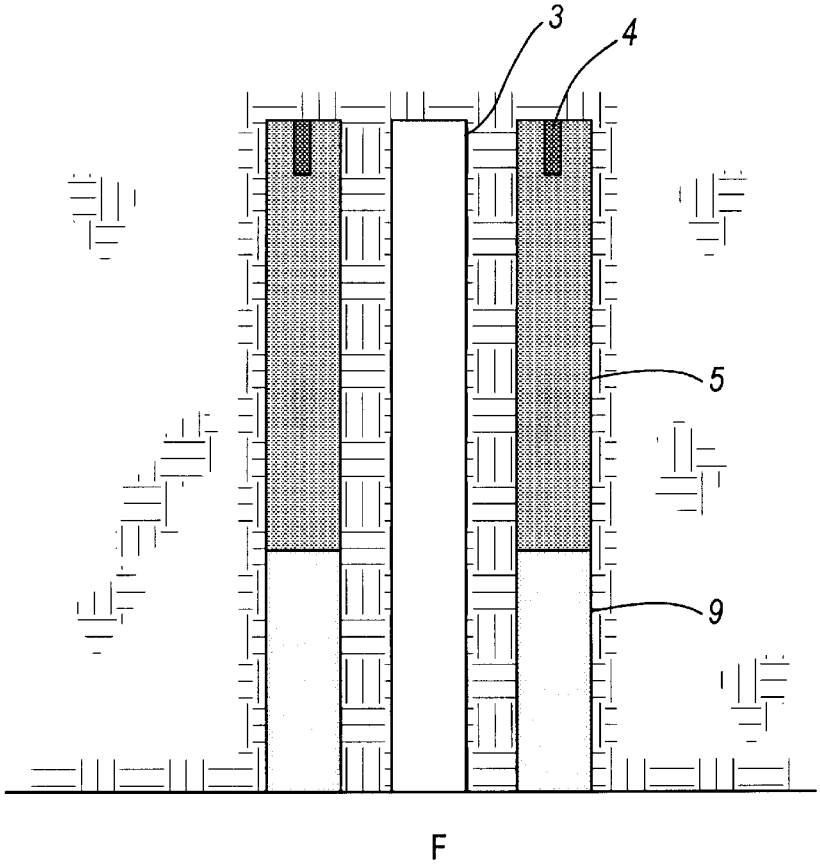
FIG. 2b PRIOR ART
FIG. 2*b* is a cross section showing further conventionally loaded cut holes.
Figure 2C:
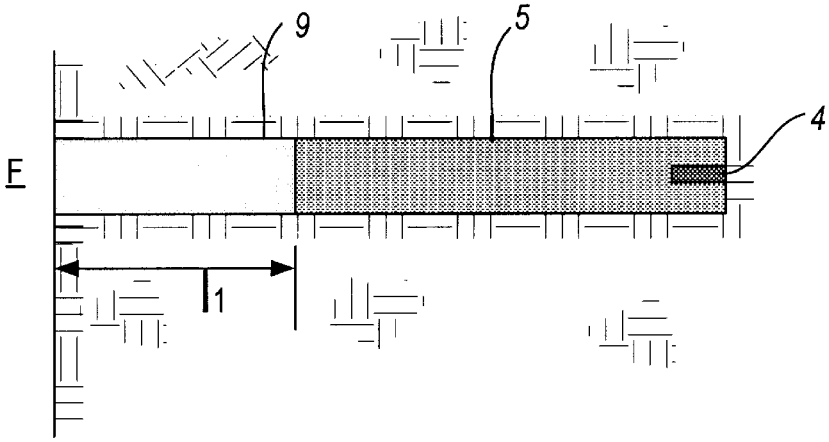
FIG. 2c PRIOR ART
FIG. 2*c* is a cross section showing a conventionally loaded cut spreader hole.
Figure 2D:
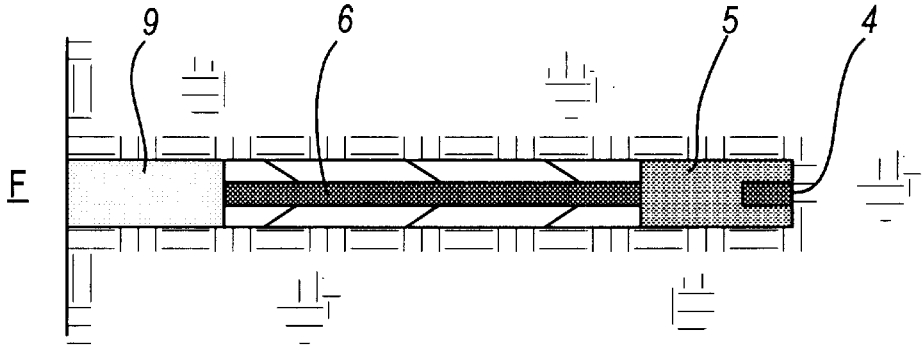
FIG. 2d PRIOR ART
FIG. 2*d* is a cross section showing a conventionally loaded roof hole.
Figure 3A:
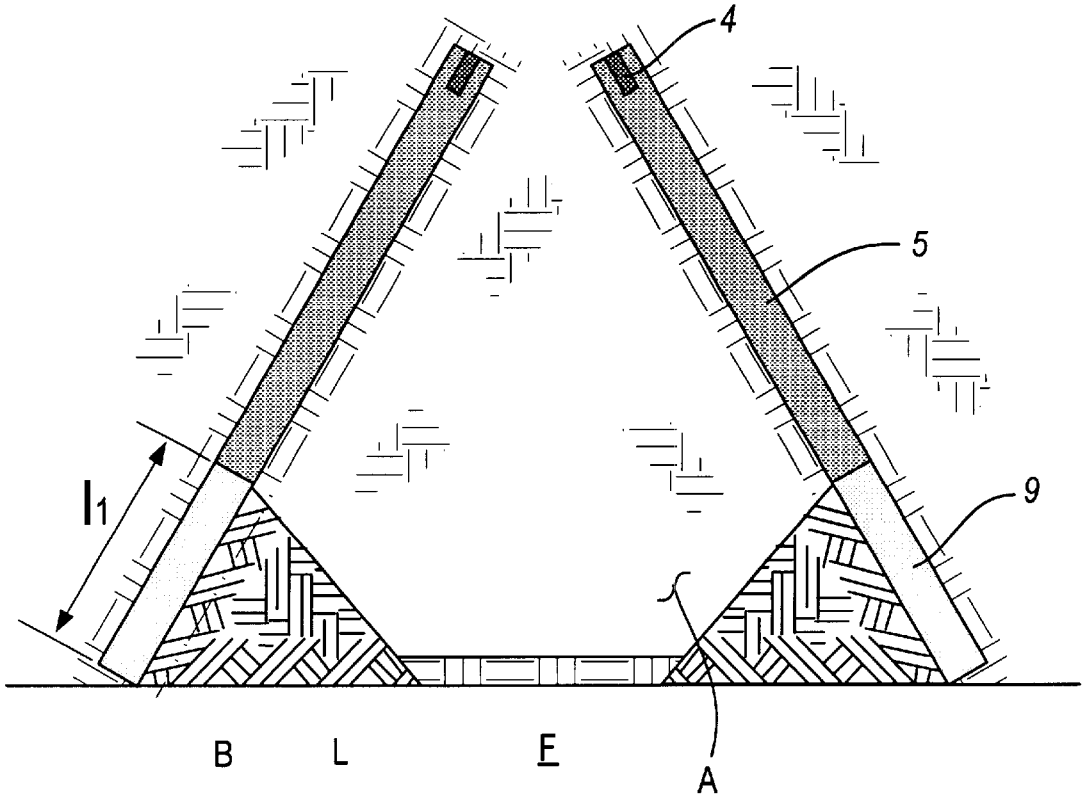
FIGS. 3*a* to 3*c* are cross sections showing blasting action in various blast holes.
Figure 3B:
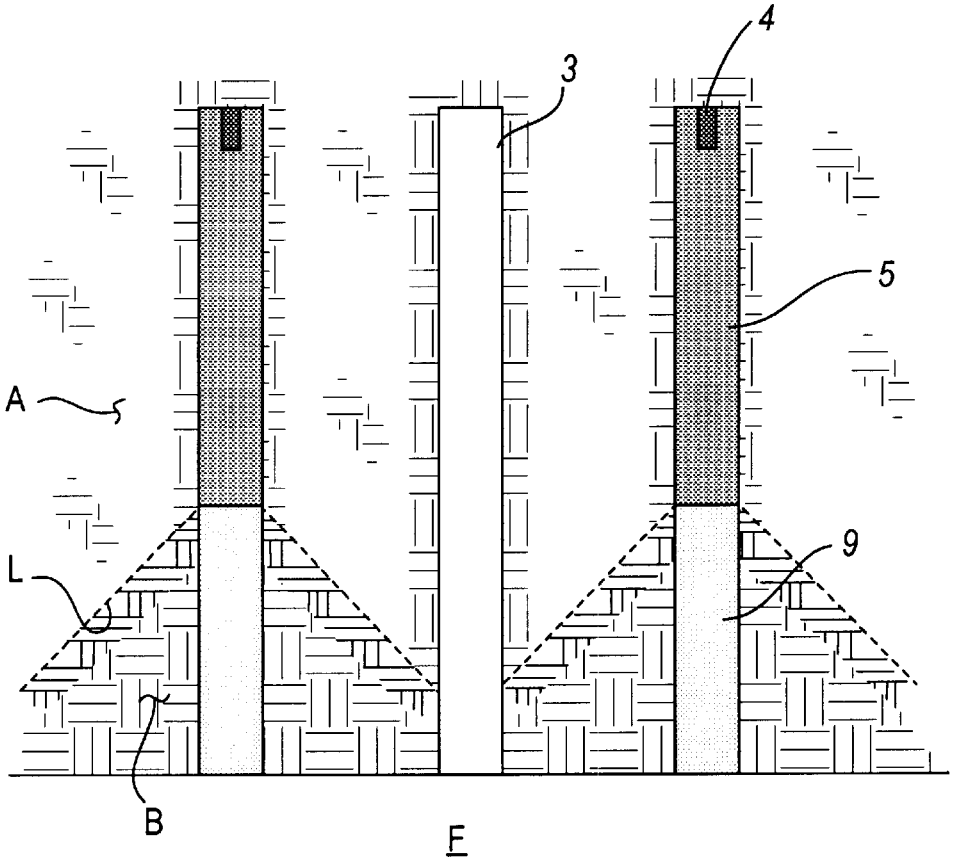
Figure 3C:
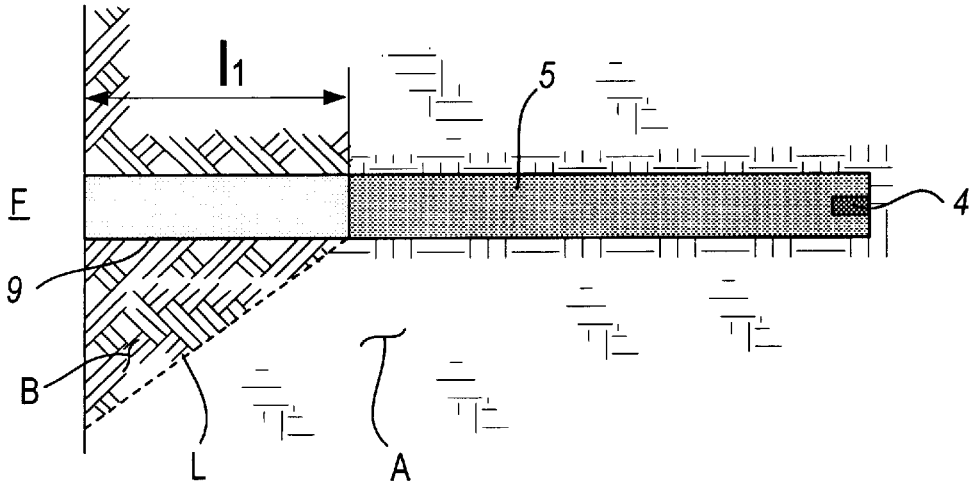
Figure 4:
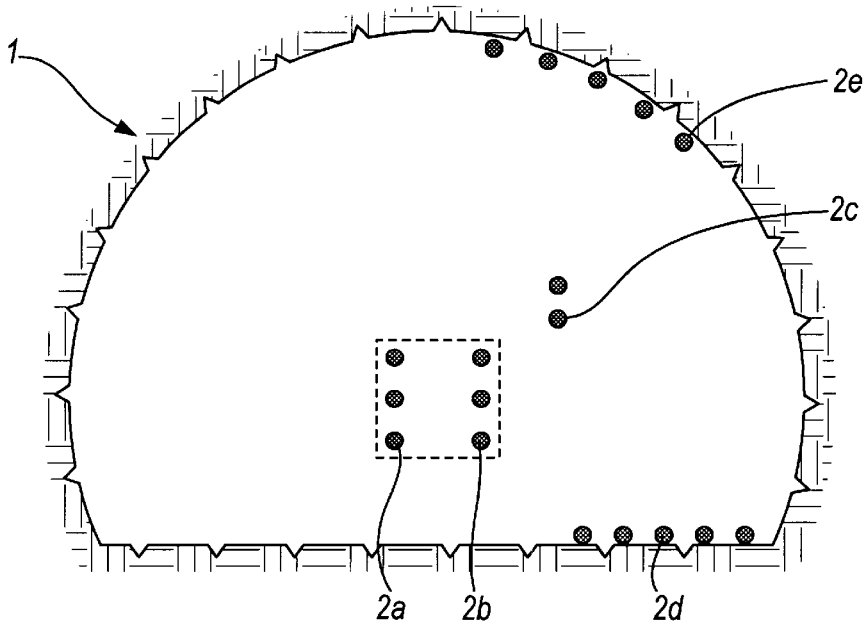
FIG. 4 PRIOR ART
FIG. 4 is a front view showing a conventional blast hole arrangement.

Reference now should be made to the drawings, in which the same reference numerals are used throughout the different drawings to designate the same or similar components.

The tunnel blasting method of the present invention can be applied to a tunnel blasting method, which comprises the steps of drilling blast holes 2, such as cut holes 2*a* and 2*b*, cut spreader holes 2*c*, floor holes 2*d* and roof holes 2*e*, to predetermined depths and in a predetermined arrangement, loading the blast holes 2 with one or more detonator 4 and explosives 5, stemming the blast holes 2 with stemming material 9, and detonating the detonators 4 using a triggering device (not shown). In accordance with the present invention, one or more air bladders 7 respectively having predetermined lengths are situated in each blast hole 2. As a result, air layers having a front free surface $u_1$ and/or a small free surface f are formed in each blast hole 2, so that the projective area toward the free surface F of a rock is expanded to increase a total blast pressure, thereby increasing the fracture rate of the rock and reducing blast vibration and blast noise.

Figure 6A:
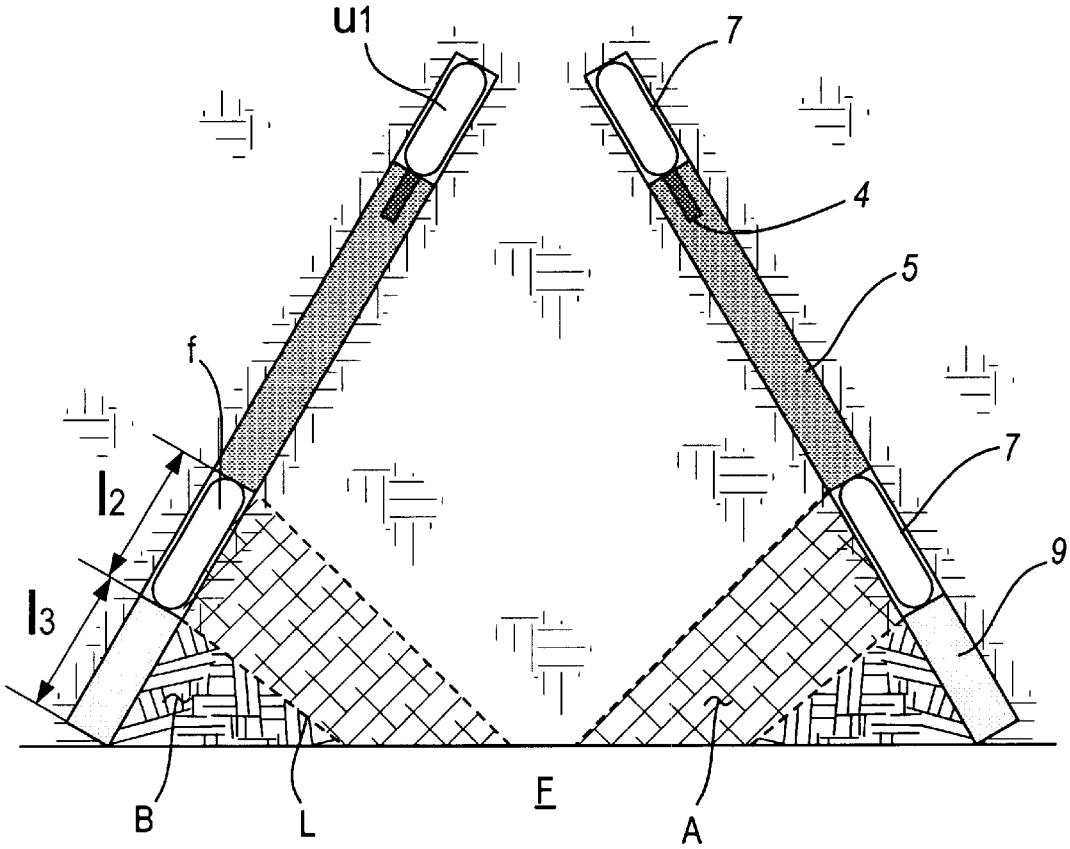
FIGS. 6*a* to 6*c* are cross sections showing blasting action in various blast holes in accordance with the present invention.
Figure 6B:
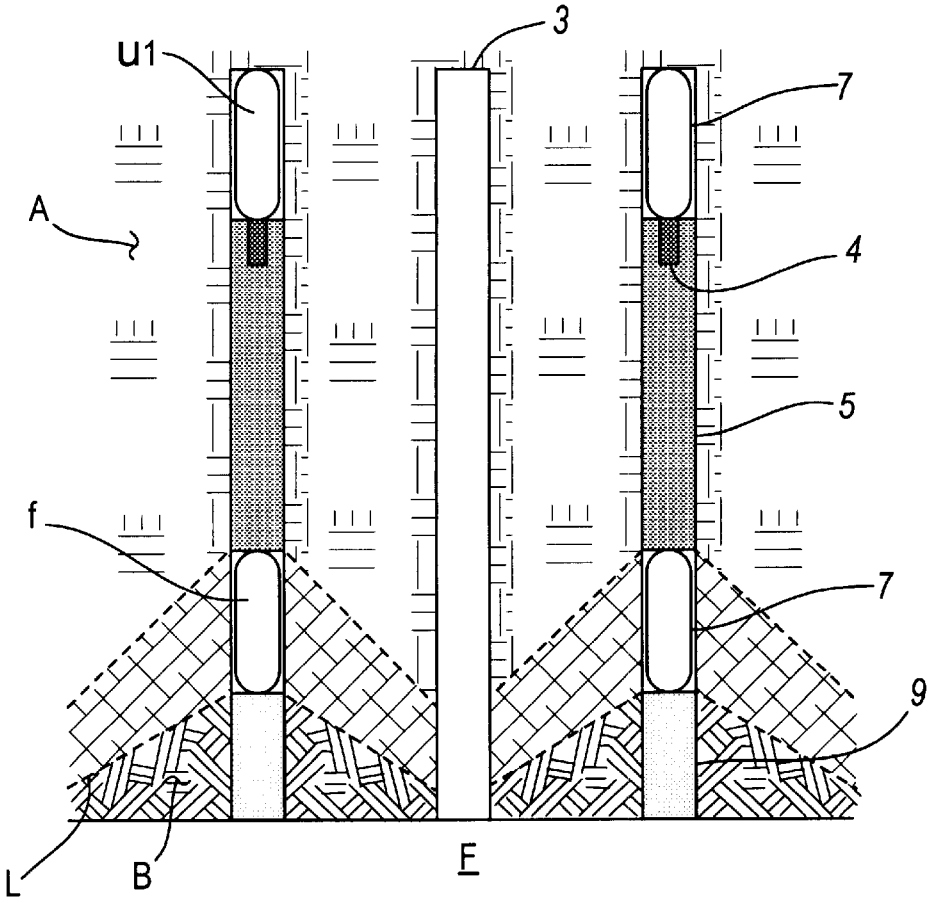
Figure 6C:
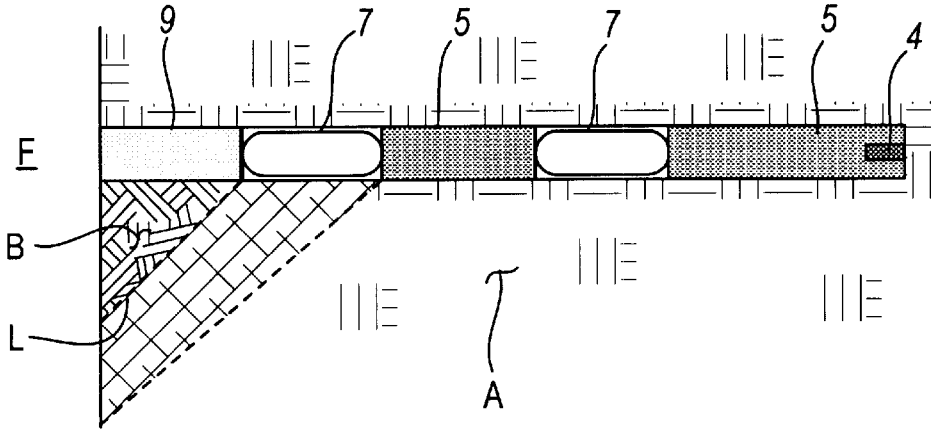

The tunnel blasting method of the present invention is characterized in that the explosives 5 are detonated in the blast holes 2 while the air bladders 7 are situated in the vicinity of the explosives 5. As shown in FIGS. 6*a* to 6*c*, the air bladders 7 are respectively inserted into the inner portions of the cut holes 2*a* and 2*b* to form the front free surfaces $u_1$ in the cut holes 2*a* and 2*b* and the air bladders 7 are respectively inserted into the cut holes 2*a* and 2*b* outside of the explosive charges 5 to form the small free surfaces f in the cut holes 2*a* and 2*b*, so that the air bladders 7 cause the detonation velocity of the explosives 5 to be delayed to allow blast energy to be exerted on the surface of the rock in the cut holes 2*a* and 2*b*, thereby reducing blast vibration and blast noise.

In addition, a fracture boundary line L is retreated by the length $l_2$ of the air bladder 7 by means of the air bladder 7, so that the projective area toward the free surface F is enlarged. Accordingly, blast energy is exerted on the increased projective area to increase the amount of the fracture of the rock, and the stemming length $l_3$ of the stemming material 9 is shortened to reduce the sizes of boulders.

That is, the fracture boundary line L is retreated by means of the air bladder 7 to increase total blast pressure, so that more blast energy of the explosives 5 is utilized to fragment the rock and less blast energy remains in the rock, thus reducing blast vibration. Additionally, the air bladder 7 serves as a small free surface f, thereby also reducing blast vibration.

When the air bladder 7 is positioned outside of the explosive 5 in the blast hole 2, the length $l_3$ of the stemming material 9 is reduced, thereby retreating the fracture boundary line L by the length $l_2$ of the air bladder 7 toward the free surface F. The projective area is increased by the retreat of the fracture boundary line L, so that a relatively small amount of explosives are capable of easily fragmenting a rock.

In addition, the length $l_3$ of the stemming material if the stemming material 9 can be reduced by the length $l_2$ of the air bladder 7, so that the production of boulders is reduced during blasting operations.

The relation between the projective area and the total blast pressure can be expressed as follows:

$$B=A\ \{A/(Ca\cdot R)\}$$

where B is a burden, A is a projective area, Ca is the coefficient of rock and R is the marginal length of loading chamber.

For example, in a case where the diameter of a blast hole is 75 mm and the length of the blast hole is 9 m, there are calculated as follows the total blast pressure obtained through the conventional tunnel blasting method in a case where the length of an explosive is 6 m and the length of a stemming material is 3 m and the total blast pressure obtained through the tunnel blasting method of the present invention in another case where the length of the explosive is 6 m, the length of the air bladder is 2.5 m and the length of the stemming material is 0.5 m.

The projective area according to the conventional method is $A_1$=600 cm×7.5 cm=4,500 $cm^2$, and the projective area according to the method of the present invention is $A_2$=850 cm×7.5 cm=6,375 $cm^2$. When an acting pressure p is 6,000 $kg/cm^2$ upon the detonation of the explosive, the total blast pressure obtained through the conventional method is $P_1=A_1=p$=4,500 $cm^2$×6,000 $kg/cm^2$=27,000,000 kg=27,000 tons and the total blast pressure obtained through the method of the present invention is $P_2=A_2\times p$=6,375 $cm^2$6,000 $kg/cm^2$=38,250,000 kg=38,250 tons. The difference between the total blast pressures is $P_2-P_1$=38,250 tons−27,000 tons. In conclusion, the total blast pressure is increased through the method of the present invention by about 42% in comparison with the conventional method.

In the present invention, the principal reasons why the air bladders 7 are employed are that a rock is caused to be fragmented easily, blast vibration is controlled and the amount of an explosive is reduced, by the formation of an artificial small free surface f. The volume of the air bladder 7, that is, the amount of air contained in the bladder 7, can be adjusted depending upon the properties of a rock.

The air bladders 2 that will be situated in the blast holes may be made of synthetic resin, such as polyethylene, polypropylene, polyester or polyamide. Each air bladder 2 has a predetermined thickness and a predetermined length, and is provided with one or more air inlets that are capable of being closed after the insertion of air.

The length of each air bladder 7 is preferably 10 to 300 cm to allow the sympathetic detonation to be performed. The thickness and diameter of the air bladder 7 may be variously determined. For example, the diameter of the air bladder 7 may be in a range from 5 to 160 mm.

When air is injected into the air bladder 7 through the air inlets, the air bladder 7 is inflated in the form of a sphere, thereby closing the air inlets. In such a state, the air bladder 7 is inserted into the blast hole 2. This air bladder 7 can be mass-produced mechanically, thus being manufactured easily and at a low cost.

The air bladder 7 is formed to have a diameter equal to or less than the diameter of each blast hole 2 while being inflated, so as to be easily inserted into the blast hole. The air bladder 7 is pressed upon by the explosive 5 and the stemming material 9, so that it is expanded laterally and brought into contact with the wall of the blast hole while being situated in the blast hole.

The explosive 5 employed in the present invention can be a general explosive employed in general blasting operations. The detonator 4 employed in the present invention can be a delay electric or non-electric detonator. The number of delay of detonators is preferably large for a blast hole 2 that is alternately loaded with the explosives 5 and the air bladders 7.

Figure 5A:
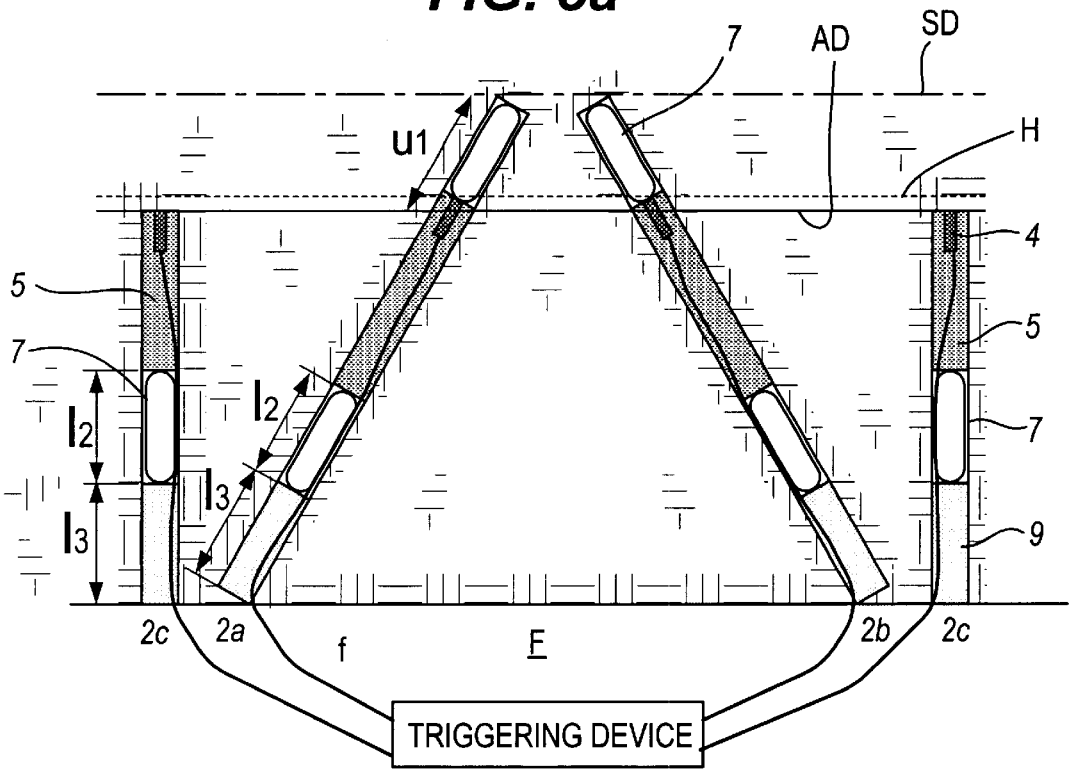
FIG. 5*a* is a cross section showing cut holes loaded in accordance with a first embodiment of the present invention.
Figure 5B:
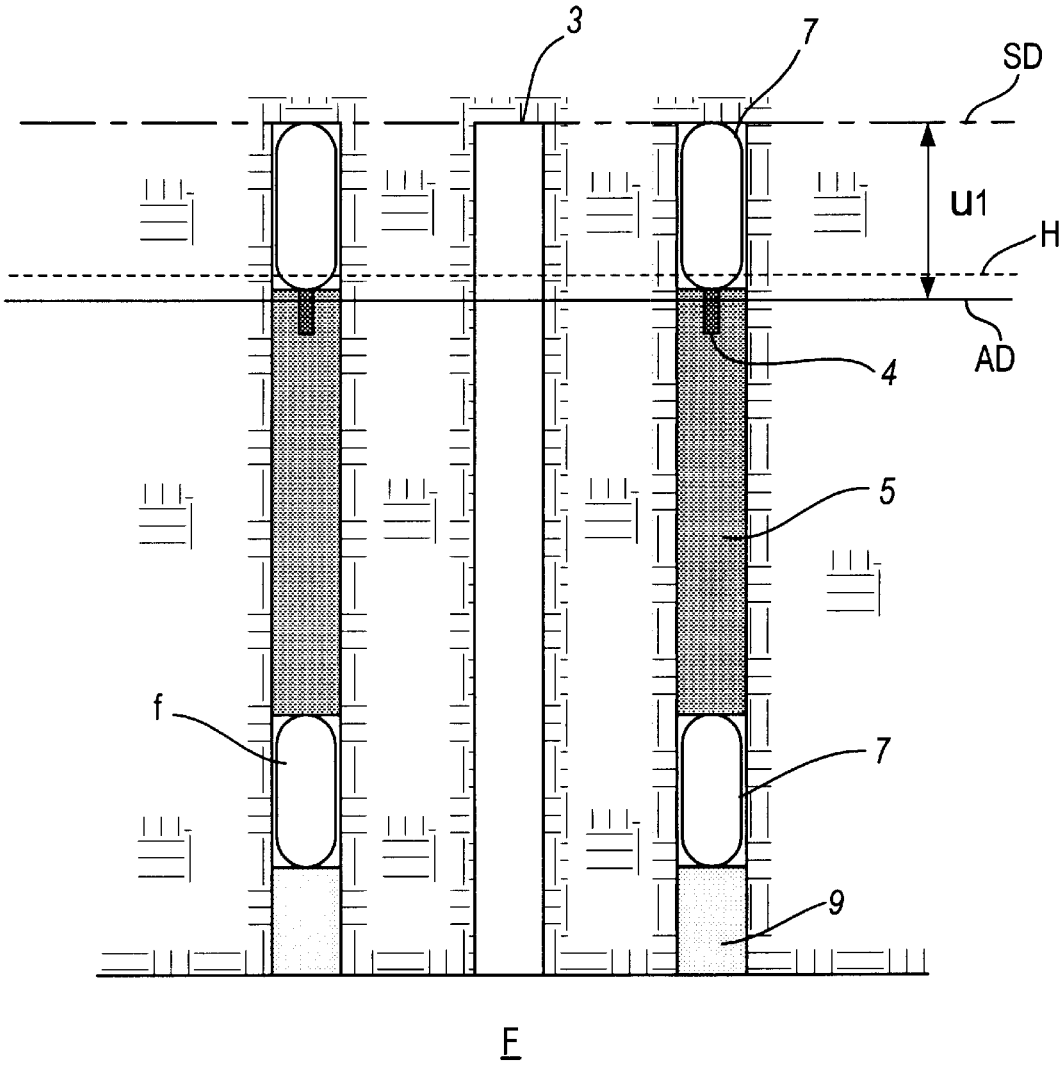
FIG. 5*b* is a cross section showing cut holes loaded in accordance with a second embodiment of the present invention.
Figure 5C:
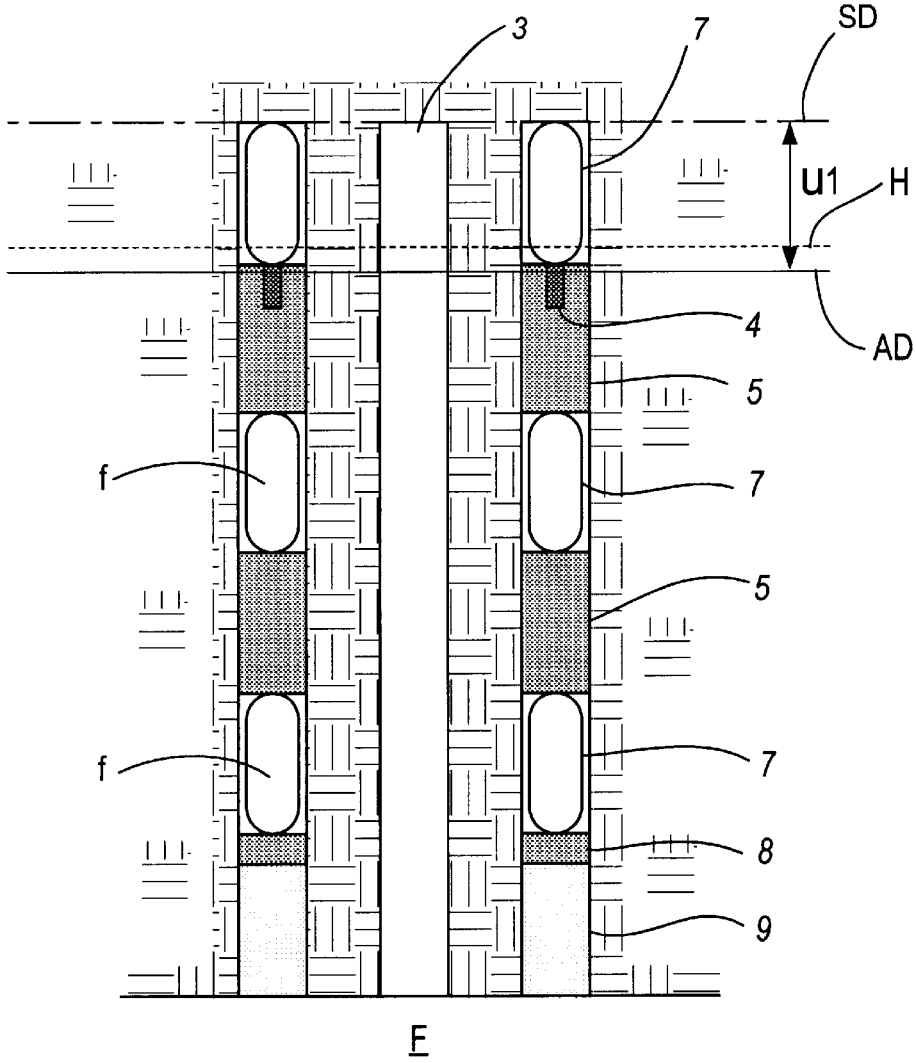
FIG. 5*c* is a cross section showing cut holes loaded in accordance with a third embodiment of the present invention, in which rubber plugs are respectively inserted into the outer portions of the cut holes.
Figure 5D:
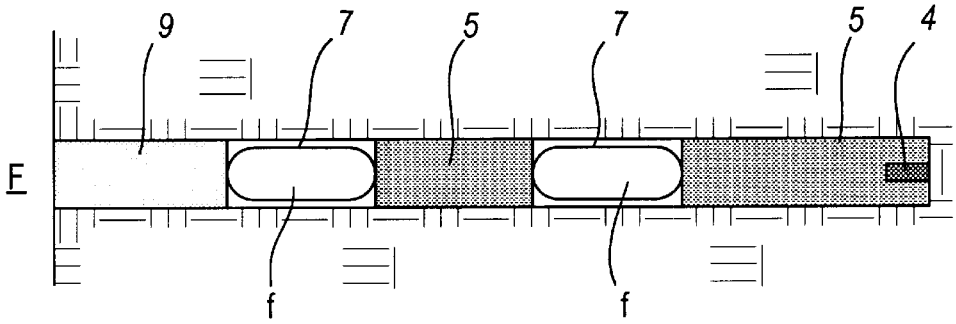
FIG. 5*d* is a cross section showing a cut spreader hole or floor hole loaded in accordance with the present invention.
Figure 5E:
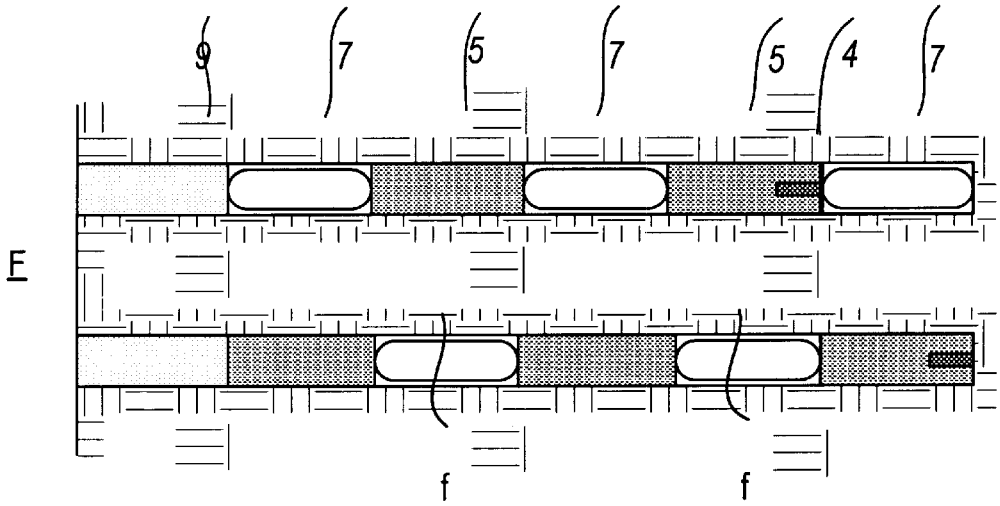
FIG. 5*e* is a cross section showing roof holes loaded in accordance with the present invention.

FIGS. 5*c* to 5*e* are views showing examples of a tunnel blasting method using sympathetic detonation, in which each blast hole 2 is alternately loaded with the explosives 5 and the air bladders 7 and a single detonator 4 is mounted in the innermost one of the explosives 5.

The sympathetic detonation is affected by the interval between two neighboring explosives 5 and the diameter of the explosives 5. The index of sympathetic detonation can be expressed by n=S/d where S is the maximum interval between two explosives (mm) and d is the diameter of each explosive (mm). The value of n is 2.5 in air, but is increased in a blast hole. For example, the maximum interval between two explosives becomes 10 to 16 when a blast hole having a diameter of 45 to 165 mm is loaded with explosives having a diameter of 50 to 100 cm. Accordingly, each air bladder 7 may be formed to have a length $l_2$ of 10 to 300 cm, to constitute a relatively lengthy air layer in a blast hole.

In a case where a blast hole 2 is alternately loaded with explosives 5 and air bladders 7, that is, as shown in FIGS. 5*c* to 5*e*, air bladders 7 are interposed between explosives 5, neighboring explosives 5 are sequentially blasted by the action of sympathetic detonation during the detonation of the explosives 5 though spaced apart from each other by a certain interval in surrounded small free surfaces f. As a result, even though a detonator 4 is mounted in every explosive 5, every explosive 5 can be detonated sequentially. Consequently, many explosives 5 are not necessary, so that the cost of blasting can be economized.

Meanwhile, the stemming material 9 may generally be a sand bag containing sand. The stemming material 9 serves to seal the entrance of the blast hole 9 that is loaded with the explosives 5 so as to allow the explosion power of the explosives 5 to act on the fragmentation of a rock effectively and to prevent gas pressure and noise generated during the denotation of the explosives 5 from escaping out of the blast hole 2.

The length of the stemming material 9 directly depends on the diameter of the blast hole 2. In general, the length of the stemming material 9 is determined on the basis of experimental results in which stemming materials 9 having the lengths of 18 cm, 45 cm and 50 cm are respectively required for the blast holes 2 having the diameters of 25 mm, 50 mm and 70 mm. In the tunnel blasting method of the present invention, the length of the stemming material 9 can be determined to be less than in the conventional tunnel blasting method.

In a case where twenty blast holes respectively having diameters of 75 mm are drilled, the bit of a drilling machine is worn and accordingly the diameter of the last blast hole dwindles to be about 65 mm. As the diameter of the blast hole dwindles, the length of the stemming material 9 is varied. If the lengths of the stemming materials 9 are not uniform, the fragmentation rates are not uniform over a rock. In order to compensate for the different lengths of the stemming materials 9, the length of the air bladder 7, that is, the volume of the air bladder 7, can be adjusted As depicted in FIG. 5*c,* a rubber plug 8 may be fitted into the blast hole 2 outside of the outermost air bladder 7 to intercept the blast noise generated during blasting operations, thereby reducing the blast noise.

Hereinafter, there is described the examples of the present invention in which blast holes are blasted while air bladders are situated in the blast holes.

As depicted in FIGS. 5*a,* 5*d* and 5*e,* the present invention provides a tunnel blasting method in which air bladders 7 are respectively situated inside of explosives 5 in cut holes 2*a* and 2*b* and cut spreader holes 2*c,* outside of the explosives 5 in cut holes 2*a* and 2*b* and cut spreader holes 2*c,* and between the explosives 5 in cut holes 2*a* and 2*b* and cut spreader holes 2*c.* In accordance with the present invention, the positions of the explosives 5 in the conventional tunnel blasting method are changed. Detonators 4 are situated in the same positions as in the conventional method or at predetermined detonation positions. Thereafter, the outer portions of the holes 2*a,* 2*b* and 2*c* are stemmed with stemming materials 9. In such a state, the detonators 4 are detonated at time intervals desired by a user using a general triggering device, multistage triggering device or non-electric triggering device. The explosives 5 are detonated in the blast holes 2 in a fashion different from the conventional fashion.

The cut holes 2*a* and 2*b* are drilled in a V-cut type as shown in FIG. 5*a,* or in a burn-cut type as shown in FIGS. 5*b* and 5*c.* Accordingly, the length of the holes is equal to or greater than an advance that forms an advance line up to which a tunnel is excavated.

In these examples, the blast holes 2 are drilled past the advance line and the air bladders 7 are respectively situated in the extended portions of the blast holes 2. As a result, the explosives can be detonated while front free surfaces $u_1$ are achieved, so as to reduce an initial vibration that is greatest in center-cut blasting.

FIG. 5*c* is a view showing a layered loading method in which each blast hole 2 is alternately loaded with explosives 5 and air bladders 7 and another air bladder 7 and a rubber plug 8 are situated in the outer portion of the blast hole 2. FIG. 5*d* is a view showing another layered loading method in which a cut spreader hole 2*c* or a floor hole 2*d* is alternately loaded with explosives 5 and air bladders 7 and a stemming material 9 is situated in the outer portion of the blast hole 2. FIG. 5*e* is a view showing a further layered loading method in which each roof hole or each sidewall hole is alternately loaded with explosives 5 and air bladders 7, the explosives 5 and the air bladders 7 are alternated at the opposite positions of two roof holes 2*e* or two sidewall holes, and two stemming materials 9 are situated in the outer portions of the holes. The above-mentioned layered loading methods serve to attenuate blast vibration and to reduce blast noise.

FIGS. 5*c* to 5*e* are views showing examples in which the layered explosives are detonated at minute time intervals by the action of sympathetic detonation. In the examples, since the explosives are detonated using the action of sympathetic detonation, only a single detonator is necessary but a detonating fuse is not necessary. Accordingly, in accordance with the examples, tunnel blasting can be performed at a low cost and without noise pollution and danger.

In particular, in the case of the conventional tunnel blasting method, precision explosives 6 used in the roof holes 2*e* are relatively expensive and frequently fail to explode due to their low explosiveness. On the other hand, in the case of the tunnel blasting method of the present invention, the roof holes 2*e* and the sidewall holes can be alternately loaded with cartridge explosives and general explosives, thereby allowing money to be saved and eliminating danger due to unexploded explosives.

The loading of the explosives and the air bladders may be modified in a variety of fashions. As depicted in FIG. 5*e,* each roof hole or each sidewall hole can be alternately loaded with the air bladders and cartridge or ANFO explosives, with which the cut holes 2*a* and 2*b* and the cut spreader holes 2*c* are loaded. That is, the precision explosives employed in the conventional tunnel blasting method can be replaced with the cartridge or ANFO explosives.

Additionally, in FIG. 5*e,* the explosives 5 and the air bladders 7 are alternated at the opposite positions of two roof holes 2*e* or two sidewall holes. Accordingly, the explosives 5 and the small free surfaces f are alternated at the opposite positions of neighboring roof holes 2*e* or sidewall holes, so that the small free surfaces f are utilized efficiently to improve the blasting effect of the explosives 5.

Additionally, although not depicted, the working face is blasted while another front free surface is prepared by drilling a non-loaded hole or baby-cut in the center of a cut hole, thereby attenuating blast vibration and performing center-cut effectively.

Upon blasting, the free surface of the air bladder can be connected with the non-loaded hole or baby-cut.

It should be understood that any case in which one or more air bladders are situated in a blast hole pertains to the scope of the present invention.

As a result, the present invention provides a tunnel blasting method in which one or more air bladders are situated in a blast hole together with explosives and a detonator, thereby forming a small free surface f in the blast hole and enlarging the projective area toward the free surface F. Accordingly, blast vibration is attenuated and blast noise is reduced, so that vibration and noise damage to neighboring structures or annoyance to persons can be reduced.

Hereinafter, in order to clarify the features of the present invention, an example of the present invention is compared with a comparative example.

In the example of the present invention, blast holes were drilled as described in table 1, loaded with explosives 5, detonators 4 and air bladders 7 as shown FIGS. 5*a* to 5*e,* and stemmed with stemming materials 9. In this state, the loaded explosives 5 were exploded by detonating the detonators 4.

In the comparative example, blast holes were drilled as described in table 1, loaded with explosives 5 and detonators 4 as shown FIGS. 2*a* to 2*d,* and stemmed with stemming materials 9. In this state, the loaded explosives 5 were exploded by detonating the detonators 4.

TABLE 1

| Ex. | Sectional area ($m^2$) | Length of blast hole (m) | Advance (m) | Diameter of hole (mm) | Amount of loaded explosive (kg) | Amount of loaded explosive per volume ($kg/m^3$) | Kind of detonator | Number of detonators |
|---|---|---|---|---|---|---|---|---|
| Ex. Of invention | 80 | 3.5 | 2.8 | 45 | 296.25 | 1.32 | MS electric detonator | 135 |
| Comp. Ex. | 80 | 3.5 | 2.5 | 45 | 318.75 | 1.59 | MS electric detonator | 135 |

Blast vibration and blast noise in accordance with the example of the present invention and the comparative example were measured and are given in table 2.

TABLE 2

| | Vibration (cm/sec) | | | | Noise (dB) | | | |
|---|---|---|---|---|---|---|---|---|
| Ex. | 300 m | 400 m | 500 m | 600 m | 300 m | 400 m | 500 m | 600 m |
| Ex. of the invention | 1.41 | 1.04 | 0.43 | 0.432 | 311 | 301 | 286 | 256 |
| Comp. Ex. | 4.75 | 1.24 | 0.41 | 0.55 | 318 | 302 | 291 | 263 |

In these measurements, the distance between the center of blasting and a measuring position is 300 to 600 m.

As shown in tables 1 and 2, the amount of explosive per a volume was reduced from 1.59 $kg/m^3$ to 1.32 $kg/m^3$, or about 17%. The speed of blast vibration was reduced from 0.43–1.41 cm/sec to 0.41–4.75 cm/sec, or 20–39%. Blast noise was reduced from 263–318 dB to 256–311 dB, or 7 dB.

TABLE 3

| Item | Conventional tunnel blasting | Tunnel blasting of present invention |
|---|---|---|
| Hole arrangement | A certain arrangement | Equal |
| Blasting condition | | |
| Number of blast holes | A certain number | Equal |
| Amount of loaded explosive | A certain amount | 10–20% reduced |
| Amount of loaded explosive per volume | 1.59 $kg/m^3$ | 1.32 $kg/m^3$ (17% reduced) |
| Length of air bladder | None | A certain portion of hole length (minimum 0.1–3.0 m) |
| Number of detonators | A certain number | Equal or reduced |
| Measurement result | | |
| Blast vibration | A certain size | 20–39% reduced |
| Blast noise | A certain size | 7 dB reduced |
| Measured distance | | |
| Advance | 80–90% of hole length | 90–100% of hole length |
| Roof hole and sidewall hole | Uneven | Smooth |

From table 3, it can be seen that in the case of the tunnel blasting of the present invention, blast vibration is reduced considerably, its fragmentation rate is desirable, and the production of boulders are reduced.

In these measurements, the difference in measured blast vibration is assumed to depend on the distances from the center of blasting, the amount of loaded explosives, measurement positions, rock conditions, etc.

If a rubber plug 8 is employed, blast noise is reduced by 5 to 7 dB. As a result, when a tunnel is blasted in an urban area, the rubber plugs 8 are preferably inserted into blast holes outside of the innermost air bladders.

The present invention provides a tunnel blasting method in which one or more air bladders are situated in each blast hole to form one or more artificial free surfaces f. Accordingly, the explosion length of the explosives are increased, so that the blast effect of the method is increased due to reduction in the production of boulders, and the amount of the explosives can be reduced by more than 17%.

Additionally, since the tunnel blasting method can be applied without change in the conventional blast hole drilling arrangement, the explosion power of the explosives are considerably distributed in each blast hole, thus suppressing blast vibration to the highest degree.

TABLE 4

| Item | Conventional tunnel blasting | Tunnel blasting of present invention |
|---|---|---|
| Advantage | Easy explosive loading | Reduction of 20–40% in blast vibration<br>Reduction of 5–7 dB in blast noise<br>No use of precision explosives<br>Smooth surfaces of roof holes and sidewall holes<br>Enlargement in distance between holes and burden<br>Increase of about 10% in advance<br>Reduction of 17% in amount of loaded explosive per volume and curtailment of cost of detonators and explosives<br>Curtailment of cost of stemming materials |
| Dis-advantage | Difficult control of blast vibration and blast noise<br>Employment of expensive precision explosive<br>Uneven surfaces of roof holes and sidewall holes<br>Employment of large amount of explosive<br>Possibility of extra excavation | Expensive initial manufacturing cost of air bladder (however, the cost is reduced in the case of mass production) |

As described above, the present invention provides a tunnel blasting method having the following advantages.

Firstly, the present invention provides a tunnel blasting method in which cut holes are drilled deeper than the other holes and air bladders are situated in the extended portions of the cut holes to form front free surfaces, thereby suppressing initial blast vibration and blast noise generated in the cut holes and increasing the advances of the cut holes.

Secondly, the present invention provides a tunnel blasting method, which increases a specific surface area on which explosion power is exerted, provides an additional free surface and explosives are situated near a working face, thereby reducing the total amount of explosives used.

That is, in accordance with the tunnel blasting method of the present invention, a projective area is increased, so that most explosive energy of explosives is utilized to blast the tunnel, thereby reducing blast vibration and blast noise. Additionally, since the total amount of the explosives can be reduced, blast vibration and blast noise can be reduced considerably.

Thirdly, in accordance with the tunnel blasting method of the present invention, since the explosion length of explosives is enlarged and the explosives are situated near a free surface, the explosion power of the explosives are distributed through the free surface, thereby attenuating blast vibration and reducing blast noise.

Fourthly, in accordance with the tunnel blasting method of the present invention, since explosives are detonated at predetermined time intervals using the action of sympathetic blasting, blast vibration is reduced. Additionally, when rubber plugs are inserted into the outer portions of blast holes, blast vibration can be attenuated and blast noise can be reduced.

Fifthly, in accordance with the tunnel blasting method of the present invention, the explosion length of explosives can be enlarged by means of an air bladder, so that a projective area toward a working face is enlarged, thereby increasing the total blast pressure of blasting. As a result, most explosion power of the explosives is exerted on a rock, so that the rock can be easily fragmented.

In addition, in accordance with the tunnel blasting method of the present invention, roof holes and sidewall holes can be loaded with inexpensive cartridge explosives instead of expensive precision explosives, so that danger due to the unexploded explosives can be eliminated and smooth surfaces of the tunnel can be formed without extra excavation.

In brief, the present invention provides the tunnel blasting method in which one or more air bladders are situated in each blast hole, thereby forming a front free surface in a cut hole or one or more small free surfaces in the other blast holes. As a result, a specific surface area is enlarged, so that the explosion power of explosives is uniformly exerted on a rock, thereby attenuating blast vibration and blast noise. In addition, a projective area is enlarged, so that the total blast pressure is increased and the rock is easily fragmented, thereby reducing the amount of explosive considerably.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A tunnel blasting method, comprising:

drilling blast holes including cut holes, cut spreader holes, floor holes and roof holes to predetermined depths and in a predetermined hole arrangement, loading said blast holes with one or more detonators and explosives, stemming said blast holes with stemming materials, and detonating said detonators using a triggering device, wherein said loading step comprises:

mounting one or more air bladders in each of said blast holes to form an air decking of a predetermined size so that a front free surface or one or more small free surfaces are formed, the air decking being adapted for enlarging a projective area toward said front free surface or one or more small free surfaces and increasing a total blast pressure so as to increase the fragmentation rate of rock and reduce blast vibration; and changing the lengths of said one or more air bladders according to the diameter variations of said blast holes upon the blasting operation, while maintaining the lengths of the stemming materials at least substantially constant among said blast holes.

2. The method according to claim 1, wherein said cut holes are drilled deeper than an advance line and said one or more air bladders are inserted into the deeper portions of said cut holes, so that said front free surface or one or more small surfaces are respectively formed in said cut holes and explosives are situated near said front free surface or one or more small surfaces, adapted for distributing blast vibration toward said front free surface or one or more small surfaces.

3. The method according to claim 1, wherein a single detonator is situated in each said blast hole so that said explosives are detonated by the action of sympathetic detonation.

4. The method according to claim 1, wherein the diameter of each of said one or more air bladders is equal to or less than the diameter of each of said blast holes.

5. The method according to claim 1, wherein a plurality of first blast holes each have a depth greater than a respective depth of a plurality of second blast holes, wherein each of the first and second blast holes are loaded with the at least one detonator and explosives, wherein the first blast holes each comprise the air bladder in a lower portion of the first blast hole and the at least one detonator and explosives located at a shallower depth than the air bladder, wherein each of the second blast holes have the at least one detonator and explosives located in a lower portion of the hole, and wherein the at least one detonator and explosives in each of the first and second blast holes define a blast line, with at least a portion of the air bladder being located on an opposing side of the blast line from the at least one detonator and explosives.

6. The method according to claim 1, further comprising at least one drill hole that is free of explosives.

* * * * *